US007708373B2

(12) United States Patent
Sugahara

(10) Patent No.: US 7,708,373 B2
(45) Date of Patent: May 4, 2010

(54) INK-JET HEAD AND INK-JET PRINTER

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 563 days.

(21) Appl. No.: 11/535,917

(22) Filed: Sep. 27, 2006

(65) Prior Publication Data

US 2007/0103507 A1 May 10, 2007

(30) Foreign Application Priority Data

Sep. 28, 2005 (JP) ..... 2005-282732

(51) Int. Cl.
*B41J 2/015* (2006.01)
*B41J 2/145* (2006.01)

(52) U.S. Cl. ..... 347/20; 347/40

(58) Field of Classification Search ..... 347/40, 347/20, 100, 13, 41, 12, 49, 47, 43, 19
See application file for complete search history.

(56) References Cited

U.S. PATENT DOCUMENTS 6,254,218 B1 * 7/2001 Suzuki et al. ..... 347/43
6,267,476 B1 * 7/2001 Kato et al. ..... 347/100
6,386,668 B1 * 5/2002 Shimizu et al. ..... 347/13
6,443,554 B1 * 9/2002 Yoshida ..... 347/41
6,547,355 B1 * 4/2003 Shimada et al. ..... 347/12
6,679,583 B2 * 1/2004 Vanhooydonck et al. ..... 347/41
6,846,064 B2 * 1/2005 Yamane ..... 347/40
6,869,166 B2 * 3/2005 Brugue et al. ..... 347/49
7,399,049 B2 * 7/2008 Jahana et al. ..... 347/19
7,513,600 B2 * 4/2009 Yamanobe ..... 347/43
2002/0167565 A1 * 11/2002 Maeda et al. ..... 347/40
2004/0207685 A1 * 10/2004 Otsuki ..... 347/40
2005/0140722 A1 * 6/2005 Shibata et al. ..... 347/40
2005/0264604 A1 * 12/2005 Urech ..... 347/40
2006/0279606 A1 * 12/2006 Jahana et al. ..... 347/47

FOREIGN PATENT DOCUMENTS

JP 2001018387 A 1/2001
JP 2003220705 A 8/2003

* cited by examiner

*Primary Examiner*—Stephen D Meier
*Assistant Examiner*—Carlos A Martinez, Jr.
(74) *Attorney, Agent, or Firm*—Baker Botts L.L.P.

(57) ABSTRACT

An ink-jet head has a plurality of nozzle groups which respectively jet inks of a plurality of colors. Each nozzle group has a high density portion of small nozzle interval and two low density portions of larger nozzle interval than the high density portion. The high density portion is positioned between the low density portions. Because in accompaniment with a reciprocating movement of the ink-jet head, an intermediate area, in which inks from the two low density portions land in a mixed manner, is formed between two areas, in which inks from the high density portion land, color banding is made inconspicuous and lowering of the printing quality due to differences in color can be suppressed.

14 Claims, 19 Drawing Sheets

INK-JET HEAD AND INK-JET PRINTER

CROSS REFERENCE TO RELATED APPLICATION

The present application claims priority from Japanese Patent Application No. 2005-282732, filed on Sep. 28, 2005, the disclosure of which is incorporated herein by reference in its entirety.

BACKGROUND OF THE INVENTION

1. Field of the Invention

The present invention relates to an ink-jet printer and an ink-jet head which jet inks onto a recording medium.

2. Description of the Related Art

As a color ink-jet printer which jets a plurality of color inks onto a recording medium such as a recording paper to record a color image and/or letter onto the recording medium, there is widely known an ink-jet printer having a construction in which a serial-type ink-jet head which jets a plurality of color inks from nozzles while moving in a direction (scanning direction) orthogonal to a feeding direction of the recording paper or the like. For example, an ink-jet head described in Japanese Patent Application Laid-open No. 2003-220705 has four cavity plates each of which has a cavity for jetting one of four color inks (cyan (C), magenta (M), yellow (Y), and black (K)), and in each of the cavity plates has two nozzle rows formed therein, each rows having a plurality of nozzles arranged in the feeding direction. The four cavity plates are positioned so as to be aligned in the scanning direction. Thus, as shown in FIG. 19A for example, when three kinds of nozzle groups 201 which jet three color inks respectively, are positioned in the order of cyan (201C), magenta (201M), and yellow (201Y) from the left, and when an ink-jet head 200 moves to the right, the three color inks ($I_C$, $I_M$, and $I_Y$) land on the recording paper in the order of Y (yellow), then to M (magenta), and then to C (cyan) (Y-M-C order), thereby forming a dot as shown in FIG. 18B.

SUMMARY OF THE INVENTION

In order to increase the recording speed, when the ink-jet head 200 reciprocatingly moves (reciprocates) in the scanning direction (left and right direction), it is possible to jet the inks from nozzles both during when the ink-jet head 200 moves to the left (during the leftward movement) and when the ink-jet head 200 moves to the right (during the rightward movement). In this case, however, as shown in FIGS. 18A and 18B, during the rightward movement of the ink-jet head 200, the three color inks land on the recording paper in the order of Y to M, then to C (Y-M-C order). Since the color of the ink droplet which lands last is cyan, the tint or hue of color of the image (recorded image) tends to be biased toward cyan which landed last (to be more bluish). On the other hand, as shown in FIGS. 19A and 19B, during the leftward movement of the ink-jet head 200, the inks land in the order of C to M, then to Y (C-Y-M order). In this case, since the color of the ink droplet which lands last is yellow, the tint or hue of color of the image tends to be biased toward yellow (to be more yellowish), Therefore, the color tint or hue thus varies suddenly (abruptly) between an area 202 on which the inks landed during the rightward movement and an area 203 on which the inks landed during the leftward movement, thereby forming a band pattern (color banding) in the scanning direction and thus degrading the printing quality.

An object of the present invention is to suppress the degradation of printing quality due to the difference in color tint between an area on which the inks land when an ink-jet head moves toward one side of a scanning direction and an area on which inks land when the ink-jet head moves toward the other side of the scanning direction.

According to a first aspect of the present invention, there is provided an ink-jet head which discharges a plurality of different color inks onto a recording medium, including a plurality of nozzle groups which jet the inks onto the recording medium respectively, and each of which is formed by a nozzle row formed by a plurality of nozzles arranged in a predetermined direction;

wherein each of the nozzle groups has a high density portion formed therein and positioned at a central portion thereof in the predetermined direction, and two low density portions which are positioned at both sides in the predetermined direction, respectively, of the high density portion and in which the nozzles are arranged in the predetermined direction at a spacing distance greater than a spacing distance at which the nozzles are arranged in the high density portion.

In a case that a general ink-jet head is reciprocated when a plurality of different color inks are jetted from a plurality of nozzles, respectively, during a first movement (movement directed away from a standby position of the ink-jet head; outgoing movement) and during a second movement (movement directed toward the standby position of the ink-jet head; returning movement), the order of landing of the inks during the first movement and the order of landing of the inks during the second movement are different. Therefore, an area on which the inks landed during the first movement and another area on which the inks landed during the second movement are different in tint of color (color tint), thereby adversely affecting the printing quality. According to the first aspect of the present invention, each of the nozzle groups has a high density portion and two low density portions which are positioned at both sides, respectively, of the high density portion. Accordingly, for example, it is possible to form two areas in the recording medium by jetting inks from the high density portion both during the first movement and the second movement, and at the same time, it is possible to form an intermediate area of an intermediate color tint between the two areas by jetting the inks from the two low density portions, respectively, to be landed on a portion between the two areas. In this case, since the color tint gradually varies, color banding, which would be otherwise caused due to the difference in color tint between the area on which the inks landed during the first movement and the another area on which the inks landed during the second movement, can be made inconspicuous and thus the printing quality is improved.

According to a second embodiment of the present invention, there is provided an ink-jet printer which discharges a plurality of different color inks onto a recording medium to perform printing on the recording medium, including:

the ink-jet head of the present invention; and a feeding mechanism which feeds the recording medium in an orthogonal direction orthogonal to the predetermined direction. In this case, printing can be performed at high speed while suppressing the color banding.

In the ink-jet printer of the present invention, the ink-jet head may be reciprocapable in the orthogonal direction; and the ink-jet head may jet the inks from the plurality of nozzle groups, respectively, both during movement of the ink-jet head toward one side of the orthogonal direction and during movement of the ink-jet head toward the other side of the orthogonal direction. In this case, the color banding can be reduced even when high-speed printing is performed while reciprocating the ink-jet head. In addition, since the inks are overlappingly landed at the two low density portions, even when the paper feed precision is varied or fluctuated, there will be no area at which the ink does not land at all. Accordingly, any white, streak-like areas are not formed on the recording medium on which the recording has been performed.

In the ink-jet head and the ink-jet printer of the present invention, two nozzle groups, among the plurality of nozzle groups, may be arranged at positions shifted from each other in the predetermined direction. With respect to the two nozzle groups, low density portions of one of the two nozzle groups and low density portions of the other of the two nozzle groups may be arranged adjacently in the predetermined direction. Alternatively, with respect to the two nozzle groups, low density portions of one of the two nozzle groups and low density portions of the other of the two nozzle groups may partially overlap with each other as viewed in a direction orthogonal to the predetermined direction. According to the construction, a plurality of kinds of intermediate areas are formed, for example, between two areas, onto which the inks jetted from the high density portions during the first movement and the second movement and landed thereon, respectively. Accordingly, the change of color tint is made gradual, thereby making the color banding to be inconspicuous and thus improving the printing quality.

In the ink-jet head and the ink-jet printer of the present invention, the spacing distance at which the nozzles are arranged in the low density portions of each of the nozzle groups may be two times the spacing distance at which the nozzles are arranged in the high density portion. In this case, for example, a spacing distance (resolution) between landing positions (dots) in the areas at which the inks jetted from the two low density portions landed during the first movement and the second movement, respectively, can be made same as a spacing distance between landing positions in an area at which the inks jetted from the high density portions landed.

In the ink-jet head and the ink-jet printer of the present invention, the spacing distance at which the nozzles are arranged in the low density portions of each of the nozzle groups may be increased toward both ends, in the predetermined direction, of each of the nozzle groups. In this case, since the spacing distance between the nozzles in the low density portions is varied in a stepwise manner, it is possible to form, with two low density portions, a plurality of kinds of intermediate areas between the two areas onto each of which the inks were jetted from the high density portion during one of the first movement and the second movement, without shifting the plurality of nozzle groups in the predetermined direction. Thus, the color banding is made to be inconspicuous.

In the ink-jet head and the ink-jet printer of the present invention, each of the nozzle groups may have two nozzle rows in which the nozzles are arranged at the predetermined spacing distance in the predetermined direction;

the two nozzle rows may be equal in a length in the predetermined direction; and the two nozzle rows may be arranged at positions shifted from each other in the predetermined direction. In this case, nozzle groups each of which has a high density portion and two density portions are formed by arranging two nozzle rows, having the same length and in which the nozzles are arranged at a same spacing distance, to be arranged at positions shifted from each other in the predetermined direction. Accordingly, the construction of the nozzle groups is simplified.

DETAILED DESCRIPTION OF THE PREFERRED EMBODIMENTS

An embodiment of the present invention will be explained. This embodiment is an example in which the present invention is applied to a color ink-jet printer which jets four color inks (cyan, magenta, yellow, and black) from nozzles onto a recording paper (recording medium).

Figure 1:
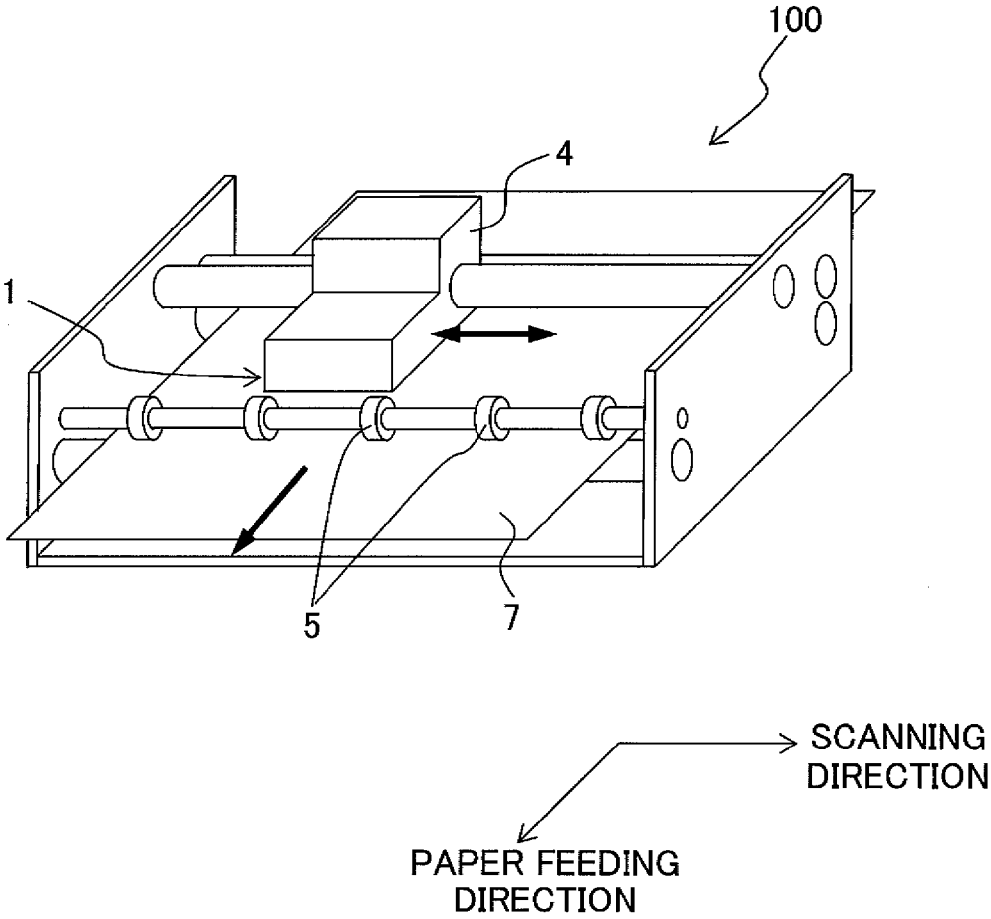
FIG. 1 is a schematic construction view of an ink-jet printer according to an embodiment of the present invention.

First, a general construction of an ink-jet printer 100 will be explained. As shown in FIG. 1, the ink-jet printer 100 includes a carriage 4 which is movable in a left and right direction of FIG. 1; a serial type ink-jet head 1 which is provided on the carriage 4 and jets inks onto a recording paper 7; feed rollers 5 (feed mechanism) which feed or transport the recording paper 7 forward in FIG. 1; and a control unit 6 (see FIG. 8) which controls overall operations of the ink-jet printer 100. The ink-jet printer 100 reciprocates the ink-jet head 1 integrally with the cartridge 4 in the left and right direction (scanning direction: first direction), and jets four color inks (cyan (C), magenta (M), yellow (Y), and black (K)) onto the recording paper 7 from nozzles 20 (see FIGS. 3 to 7) which are formed on a lower surface of the ink-jet head 1, while feeding the recording paper 7 forward by the feed rollers 5. Accordingly, a desired color image and or letter can be recorded onto the recording paper 7. In the following explanation, reference numerals or symbols having "K", "C", "M", and "Y" attached thereto indicate correspondence to the black, cyan, magenta, and yellow ink, respectively.

Figure 2:
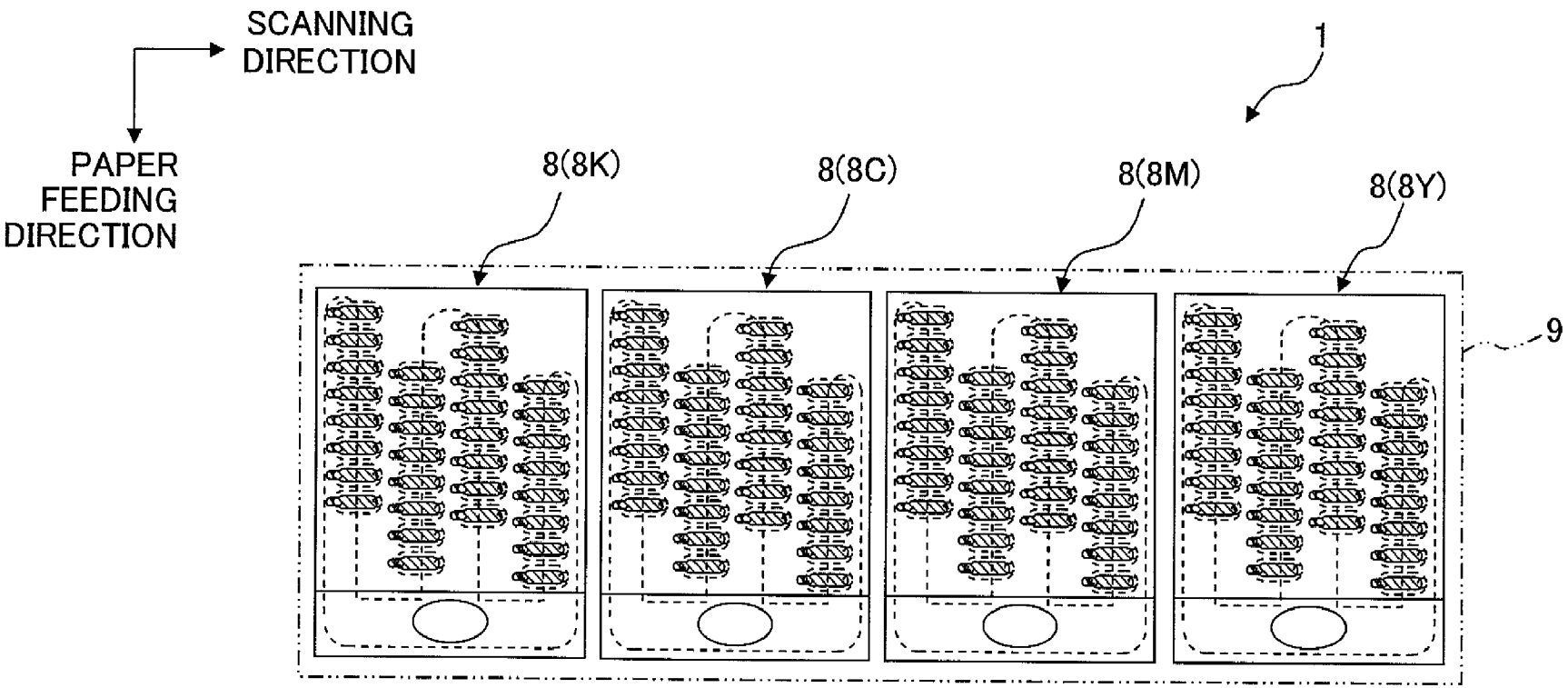
FIG. 2 is a plan view of an ink-jet head.

Next, the ink-jet head 1 will be explained. As shown in FIG. 2, the ink-jet head 1 has four jetting units 8 which are same in structure, and the four jetting units 8 have four kinds of nozzles 20 for jetting the four colors, respectively. These four jetting units 8 are attached to and made integral to a head frame 9. As shown in FIG. 2, the four jetting units 8 (8K, 8C, 8M, and 8Y) are aligned in the scanning direction in the order of black, cyan, magenta, and yellow from the left side.

Because all of the four jetting units 8 have the same structure, one of these jetting units will now be explained with reference to FIGS. 3 to 7. Each of the jetting units 8 has a channel unit 2 in which an ink channel including nozzles 20 and pressure chambers 14 are formed; and a piezoelectric actuator 3 which is arranged on an upper surface of the channel unit 2 and which applies a jetting pressure to ink inside the pressure chambers 14.

Figure 6:
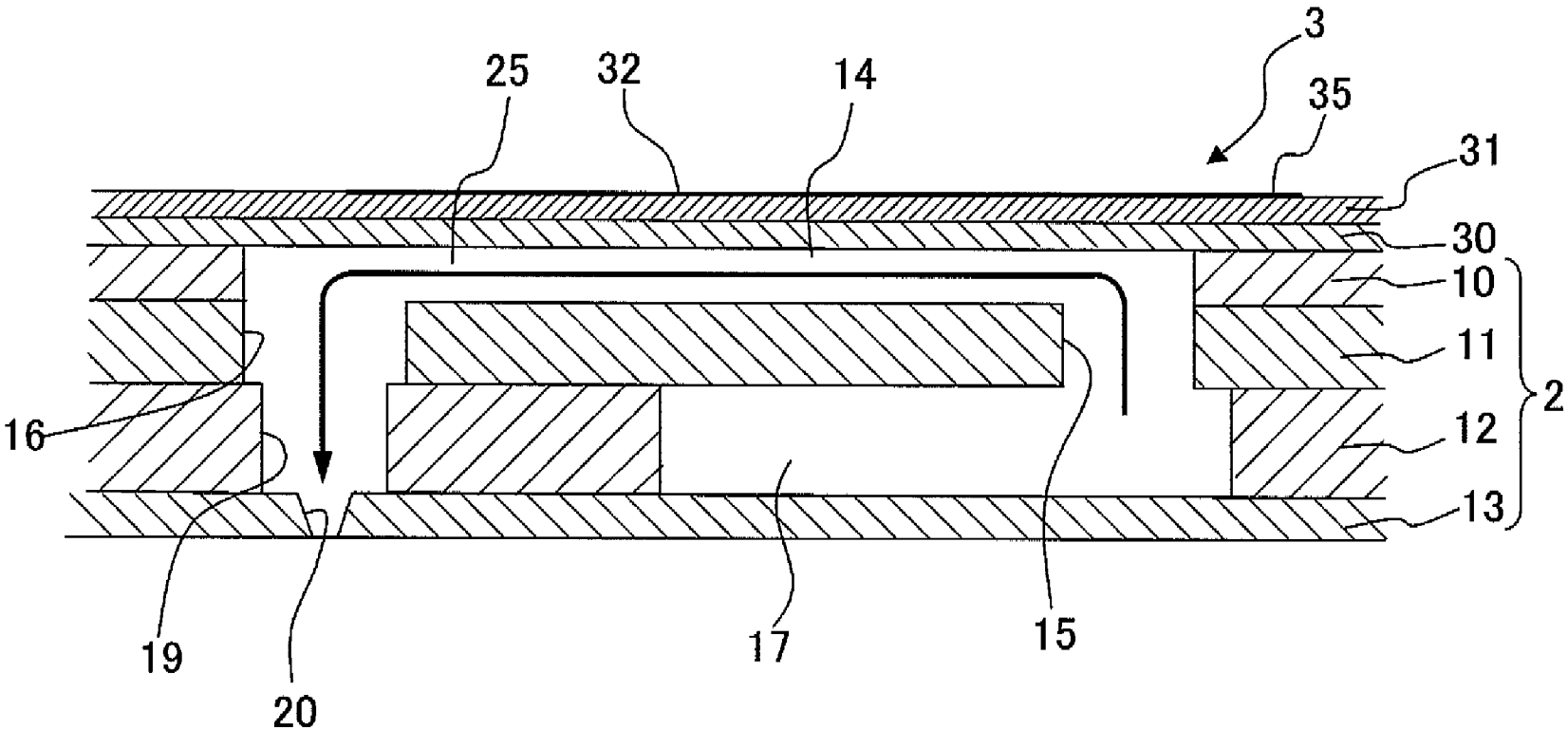
FIG. 6 is a sectional view taken on line VI-VI of FIG. 5.
Figure 7:
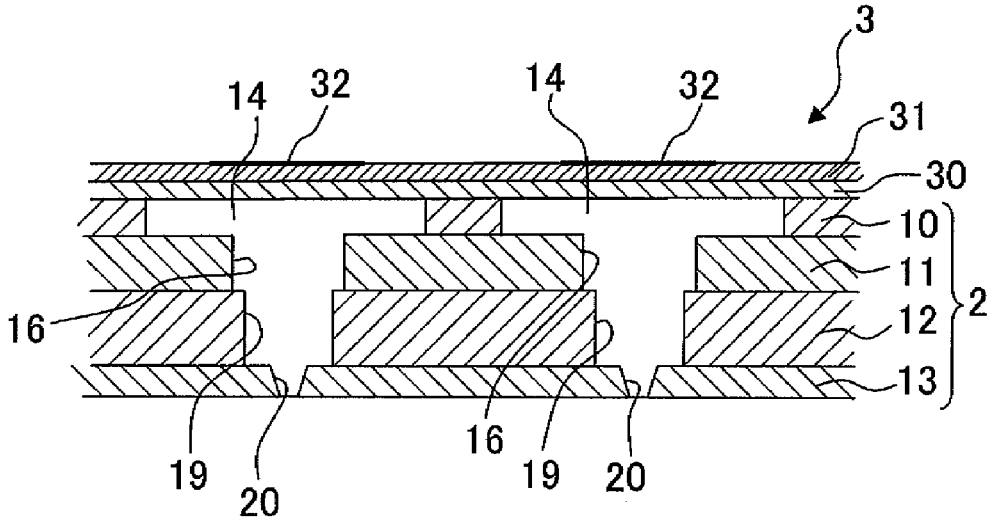
FIG. 7 is a sectional view taken on line VII-VII of FIG. 5.

First, the channel unit 2 will be explained. As shown in FIGS. 6 and 7, the channel unit 2 has a cavity plate 10, a base plate 11, a manifold plate 12, and a nozzle plate 13, and these four plates 10 to 13 are joined together in a laminated state (laminated layers). The cavity plate 10, the base plate 11, and the manifold plate 12 are stainless steel plates, and the ink channel including a manifold 17, the pressure chambers 14, and the like which will be explained later on, can be easily formed by etching in the plates 10 to 12. The nozzle plate 13 is formed, for example, of a synthetic high-molecular resin material such as polyimide and is adhered to a lower surface of the manifold plate 12. Alternatively, similarly to the three plates 10 to 12, the nozzle plate 13 may also be formed a metal material such as stainless steel.

As shown in FIGS. 3 and 5 to 7, in the cavity plate 10 positioned topmost among the four plates 10 to 13, a plurality of pressure chambers 14, arranged in arrays (rows) on a plane, are formed as holes penetrating through the plate 10, and the pressure chambers 14 are covered by the base plate 11 and a vibrating plate 30, which will be explained later, from below and above, respectively. The pressure chambers 14 are arranged in four rows aligned in a paper feeding direction (up and down direction in FIG. 3). Each of the pressure chambers 14 is formed to a substantially elliptical shape which is long in the scanning direction (left and right direction in FIG. 3).

Figure 5:
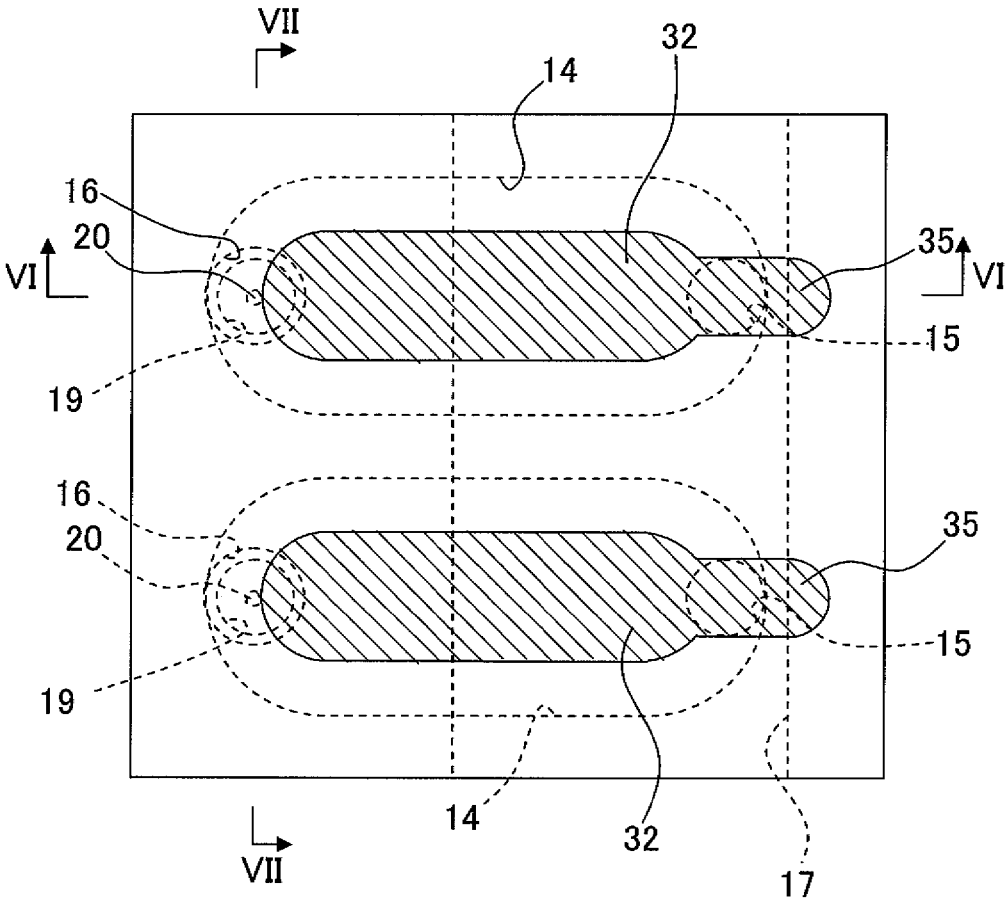
FIG. 5 is a partially enlarged view of FIG. 3.

As shown in FIGS. 5 to 7, communicating holes 15 and 16 are formed in the base plate 11 at positions overlapping in a plan view with both ends, respectively, of each of the pressure chambers 14. Further, in the manifold plate 12, three manifolds 17 which extend in the paper feeding direction (up and down direction in FIG. 3) are formed so as to overlap in plan view with the pressure chambers 14, aligned in the paper feeding direction, at portions of the pressure chambers on a side of the communication holes 15. These three manifolds 17 are communicated with an ink supply port 18 formed in the vibrating plate 30 which will be explained later, and an ink from an ink tank (not shown) is supplied into the manifolds 17 via the ink supply port 18. Furthermore, a plurality of communicating holes 19 which are communicated with the communicating holes 16, respectively, are formed in the manifold plate 12 at positions each overlapping in plan view with an end, of one of the pressure chambers 14, at a side opposite to the one of the manifolds 17.

Figure 3:
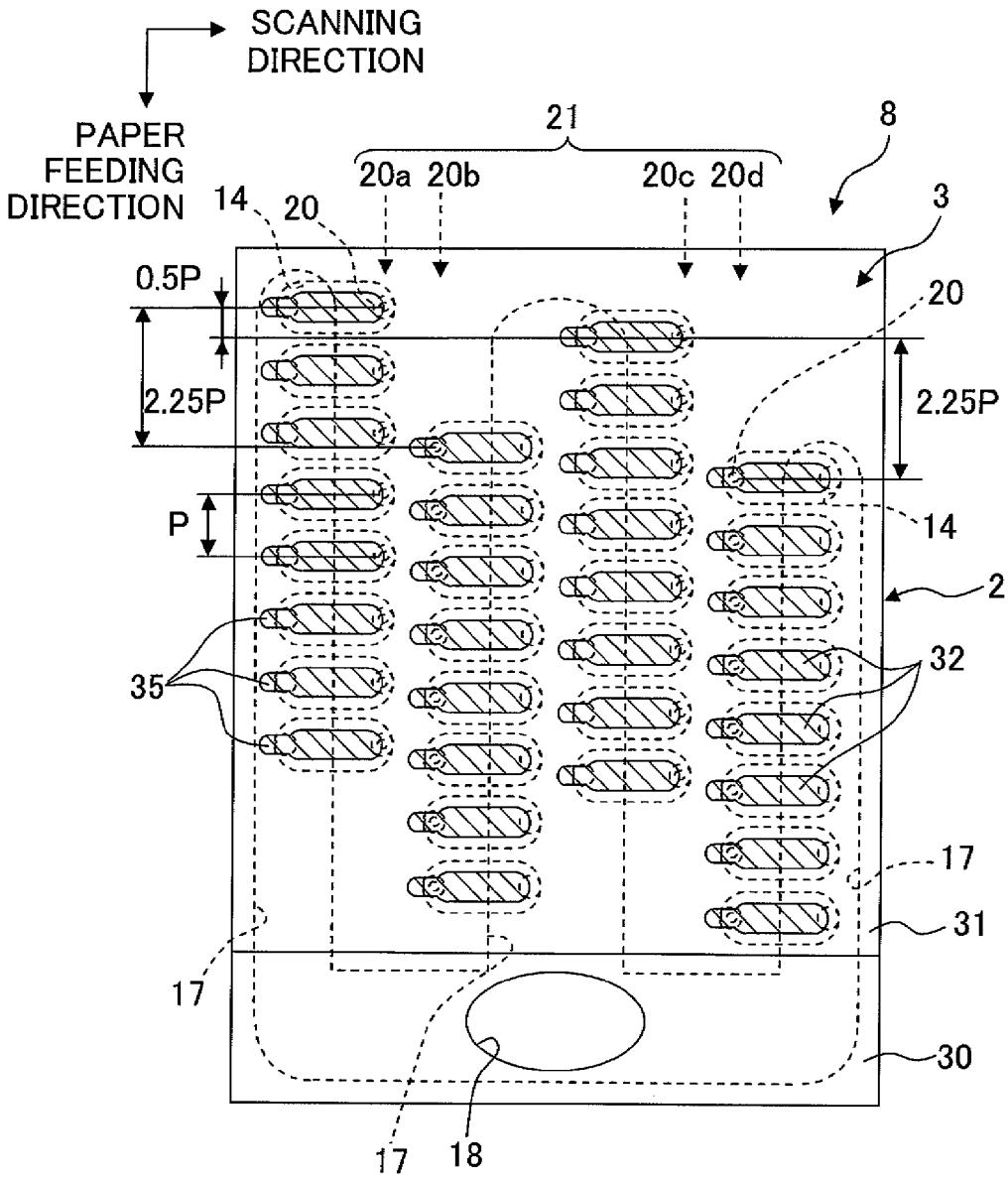
FIG. 3 is a plan view of a jetting unit.
Figure 4:
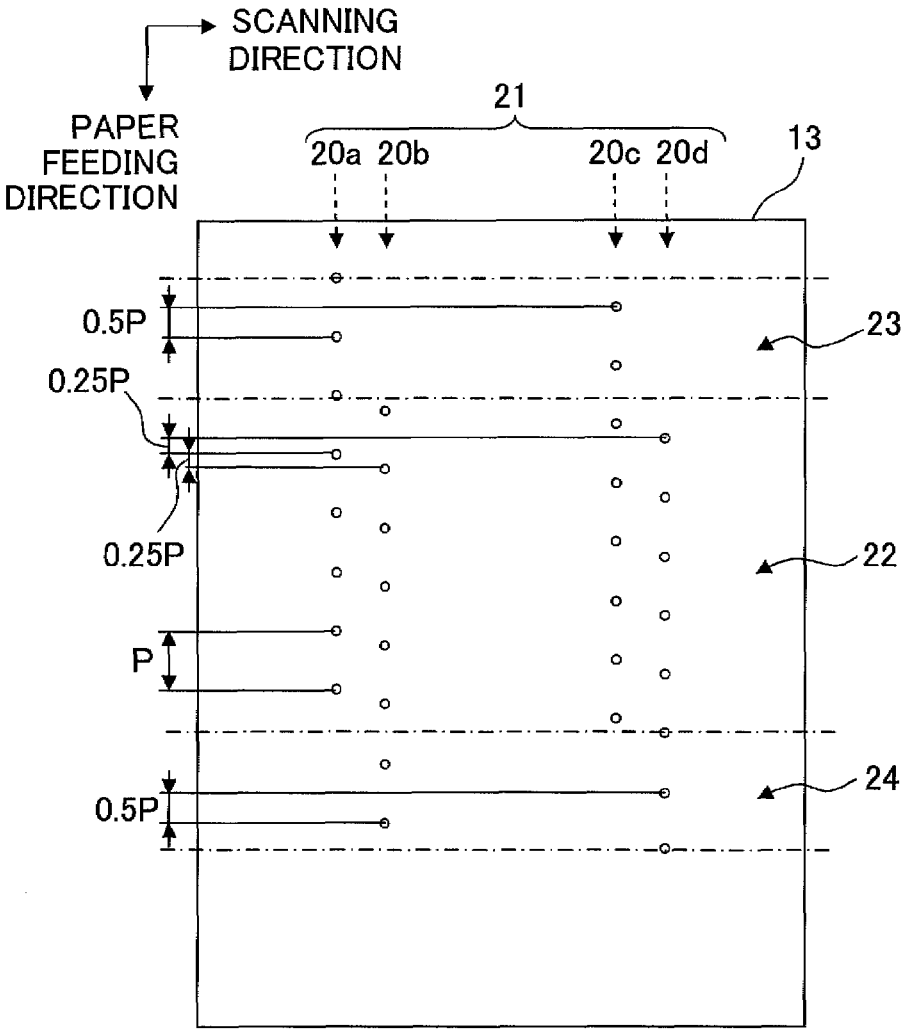
FIG. 4 is a plan view of a nozzle plate.

Moreover, the nozzles 20 are formed in the nozzle plate 13 at positions each overlapping in plan view with one of the communicating holes 19. As shown in FIGS. 3 and 4, each of the nozzles 20 overlaps with one of the pressure chambers 14, arranged into four rows, at the end thereof on the side opposite to one of the manifolds 17; and the nozzles 20 are arranged at an equal spacing distance in the paper feeding direction (up and down direction in FIG. 2; second direction), in the nozzle plate 13 at areas which do not overlap with any one of the three manifolds 17; and the nozzles 20 form a nozzle group 21 which includes four nozzle rows 20*a* to 20*d* which are aligned in the scanning direction.

As shown in FIG. 3, each of the four nozzle rows 20*a* to 20*d* has the same number of nozzles 20. In the nozzle rows 20*a* to 20*d*, spacing distance (pitch P) at which the nozzles 20 are arranged in a direction in which the nozzles are arranged (nozzle arrangement direction) is equal, and all of the nozzle rows 20*a* to 20*d* are equal in length in the nozzle arrangement direction (that is, in the number of nozzles 20 are equal among the nozzle rows 20*a* to 20*d*). Further, as shown in FIG. 3, the nozzle row 20*c* (third row from the left) is shifted with respect to the nozzle row 20*a* (first row from the left) just by a distance of ½ of the pitch P (0.5 P) toward the downstream of the paper feeding direction (downward in FIG. 3). Furthermore, the nozzle row 20*b* (second row from the left) and the nozzle row 20*d* (fourth row from the left) are shifted just by a distance of (9/4) times the pitch P (2.25 P) toward the downstream of the paper feeding direction, with respect to the nozzle row 20*a* and the nozzle row 20*c*, respectively. Accordingly, as shown in FIG. 4, the nozzle group 21, which includes the four nozzle rows 20*a* to 20*d*, has a high density portion 22, in which the nozzles are arranged in the paper feeding direction at a spacing distance of 0.25 P, and two low density portions 23 and 24 in which the nozzles are arranged at a spacing distance greater than that in the high density portion 22. The high density portion 22 is arranged at a central portion, of the nozzle plate 13, in the paper feeding direction. The low density portions 23 and 24 are arranged at both sides (upper and lower sides in FIG. 4) in the paper feeding direction of the high density portion 22, and the spacing distance between the nozzles (nozzle spacing distance) thereof in the paper feeding direction is 0.5 P (two times that of the high density portion 22). The reason as to why the high density portion 22 and the low density portions 23 and 24 which differ in nozzle spacing distances are provided will be explained in detail later.

As shown in FIG. 6, each of the manifolds 17 is communicated with one of the pressure chambers 14 via one of the communicating holes 15, and each of the pressure chambers 14 are communicated with one of the nozzles 20 via the communicating holes 16 and 19. In this manner, a plurality of individual ink channels 25 each from one of the manifolds 17 to one of the nozzles 20 via one of pressure chambers 14 are thus formed in the channel unit 2.

Next, the piezoelectric actuator 3 will be explained. As shown in FIGS. 3 and 5 to 7, the piezoelectric actuator 3 has the vibrating plate 30 arranged on an upper surface of the channel unit 2; a piezoelectric layer 31 formed continuously on an upper surface of the vibrating plate 30 to cover the pressure chambers 14; and a plurality of individual electrodes 32 formed on an upper surface of the piezoelectric layer 31 corresponding to the pressure chambers 14, respectively.

The vibrating plate 30 is a metal plate of substantially rectangular shape and has an electrically conductive property. The vibrating plate 30 is formed, for example, of an iron-based alloy such as stainless steel, a copper-based alloy, a nickel-based alloy, a titanium-based alloy, or the like. The vibrating plate 30 is arranged on the upper surface of the cavity plate 10 so as to cover the pressure chambers 14 and is joined to the cavity plate 10. The vibrating plate 30 is constantly held at a ground potential and is positioned opposite to or facing the individual electrodes 32. Accordingly, the vibration plate 30 serves also as a common electrode for making an electric field act in the piezoelectric layer 31 between the individual electrodes 32 and the vibrating plate 30, in a thickness direction of the piezoelectric layer 31.

On the upper surface of the vibration plate 30, the piezoelectric layer 31, mainly composed of a lead zirconate titanate (PZT) which is a ferroelectric solid solution of lead zirconate and lead titanate. The piezoelectric layer 31 is formed continuously so as to cover the pressure chambers 14. The piezoelectric layer 31 can be formed, for example, by an aerosol deposition (AD method) in which ultra-fine particulate material is collided onto an objective surface at high velocity so as to make the particulate material to deposit on the objective surface. Other than the AD method, the piezoelectric layer 31 can be also formed by using a method such as a sol-gel method, a sputtering method, a hydrothermal synthesis method, a chemical vapor deposition (CVD method), or the like. Still alternatively, the piezoelectric layer 31 can be formed by cutting a piezoelectric sheet, obtained by calcinating a green sheet of PZT, and then by bonding the piezoelectric sheet to the vibration plate 30.

On the upper surface of the piezoelectric layer 31, the individual electrodes 32 are formed to correspond to the pressure chambers 14, respectively. Each of the individual electrodes 32 is substantially elliptic in a plan view, is smaller to some extent than one of the pressure chambers 14 in a plan view, and is formed at a position overlapping in a plan view with a central portion of one of the pressure chambers 14 to which the individual electrode 32 corresponds. Further, the individual electrodes 32 are formed of an electrically conductive material such as gold, copper, silver, palladium, platinum, titanium, or the like. Furthermore, a plurality of contact points 35 are drawn each from left end of one of the individual electrodes 32 (one end of one of the individual electrodes 32 on the side of the manifold 17), toward the left side in FIG. 3. These contact points 35 are connected to contact points, respectively, of a flexible wiring member (not shown) such as a flexible printed circuit (FPC) or the like. The contact points 35 are electrically connected via this wiring member to a driver IC 27 (see FIG. 8) which applies a drive voltage selectively to the individual electrodes 32. The individual electrodes 32 and the contact points 35 can be formed by a method such as screen printing, the sputtering method, a vapor deposition, or the like.

Next, the operation of the piezoelectric actuator 300 upon jetting the ink will be explained. When a drive voltage is applied from the driver IC 27 selectively to the plurality of individual electrodes 32, a potential difference is generated between a certain individual electrode 32 among the individual electrodes 32, which is disposed on the piezoelectric layer 31 and to which the drive voltage is applied, and the vibration plate 30 as the common electrode which is disposed under the piezoelectric layer 31 and maintained at ground potential, thereby generating an electric field in a thickness direction of the piezoelectric layer 31 in a portion of the piezoelectric layer 31 sandwiched between the individual electrode 32 and the vibration plate 30. At this time, when a direction in which the piezoelectric layer 31 is polarized and the direction of the electric field are same, the portion of the piezoelectric layer 31, which is positioned directly below the individual electrode 32 applied with the drive voltage, expands in the thickness direction in which the piezoelectric layer 31 is polarized and contracts in a horizontal direction (direction parallel to the plane of the piezoelectric layer 31 and orthogonal to the polarization direction). Then, accompanying with the contracting deformation of the piezoelectric layer 31, the vibration plate 30 is deformed to project toward a pressure chamber 14, among the pressure chambers 14, corresponding to the individual electrode 32. Accordingly, the volume of the pressure chamber 14 is decreased to apply pressure to the ink in the pressure chamber 14, thereby jetting a droplet of the ink from a nozzle 20 communicating with the pressure chamber 14.

Figure 8:
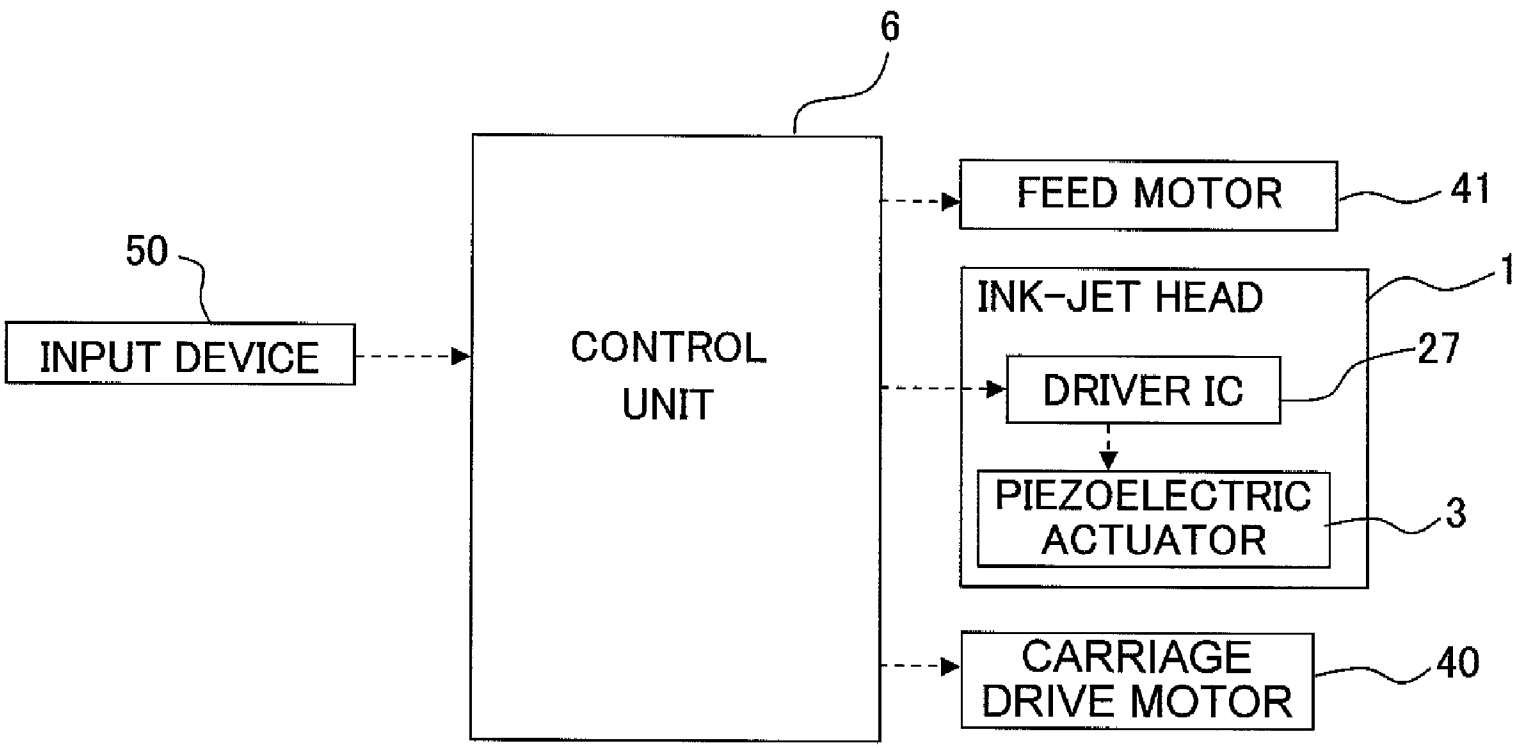
FIG. 8 is a block diagram showing an electrical construction of the ink-jet printer.

Next, an explanation will be given mainly about an electrical construction of the control unit 6, with reference to a block diagram in FIG. 8. The control unit 6 is constructed of a Central Processing Unit (CPU); a Read Only Memory (ROM) which stores a various kinds of programs and data, and the like for controlling entire operations of the ink-jet printer 100; and a Random Access Memory (RAM) which temporarily stores data and the like which are processed in the CPU; and the like.

Data concerning a character and/or an image to be recorded are inputted into the control unit 6 from an input device 50 such as PC. When data are inputted from the input device 50, the control unit 6 outputs a drive signal, based on the data, to the driver IC 27 of the ink-jet head 1, to a carriage drive motor 40 which drives the carriage 4 in the scanning direction, to a feed motor 41 which rotatingly drives the feed rollers 5, and the like. That is, the control unit 6 reciprocates the ink-jet head 1 in the scanning direction by the carriage drive motor 40 while feeding the recording paper 7 forward by rotating the feed rollers 5 by the feed motor 41, and makes the plurality of color inks be jetted onto the recording paper 7 by the ink-jet head 1. Further, the control unit 6 controls the driver IC 27, the motors 40 and 41, and the like so that upon moving the ink-jet head 1 to reciprocate in the scanning direction, the inks are jetted from the nozzle groups 21 of the four jetting units 8, respectively, both during the rightward movement (first moving direction) in FIG. 1 and during the leftward movement (second moving direction) in FIG. 1. In this case, the recording speed is made faster in comparison to a case where the inks are jetted during only one of the movement in the first moving direction and the movement in the second moving direction.

Figure 18A:
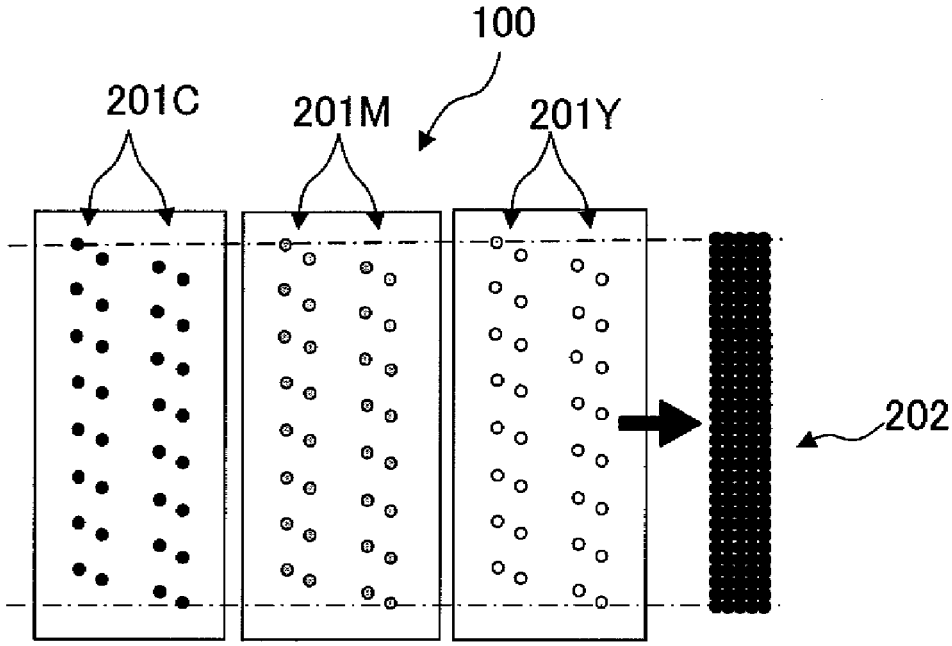
FIG. 18A is a diagram showing a conventional ink-jet head in a state in which the color inks land during a rightward movement of the conventional ink-jet head.
Figure 18B:
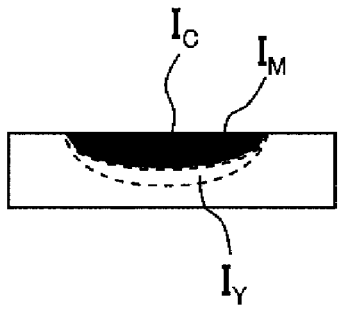
FIG. 18B is a partial sectional view of a recording paper showing the order in which the color inks land during the rightward movement of the conventional ink-jet head.
Figure 19A:
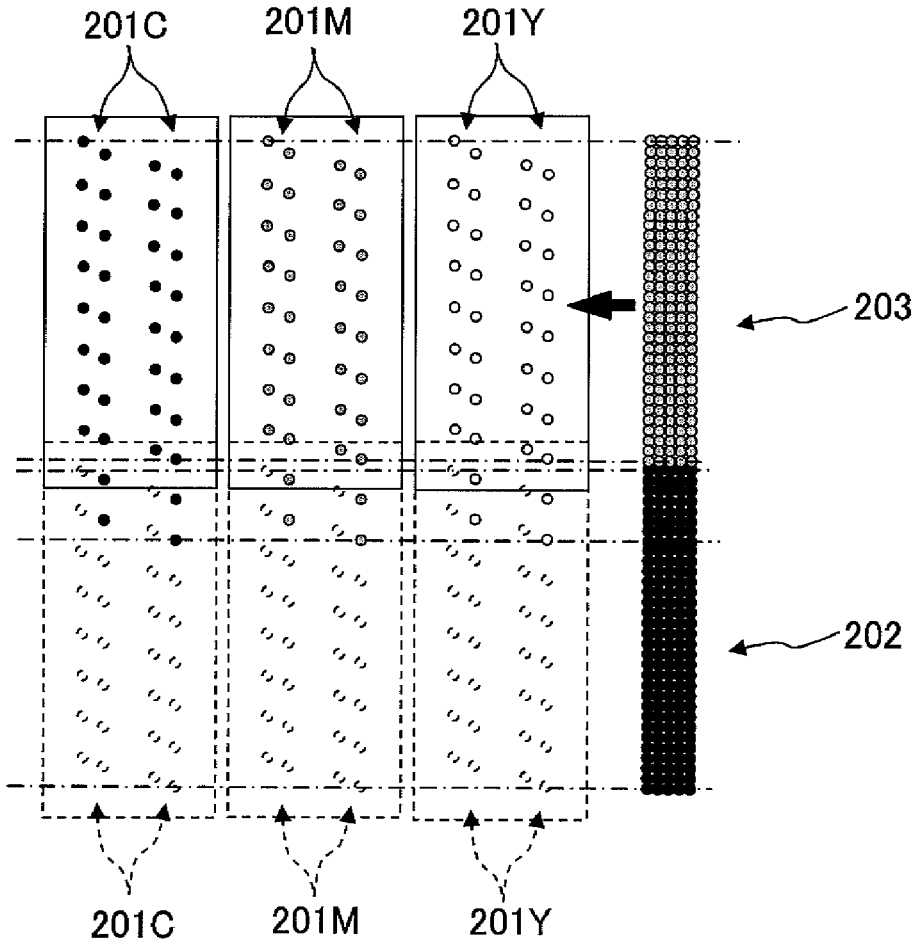
FIG. 19A is a diagram showing the conventional ink-jet head in a state in which the color inks land during a leftward movement of the conventional ink-jet head.
Figure 19B:
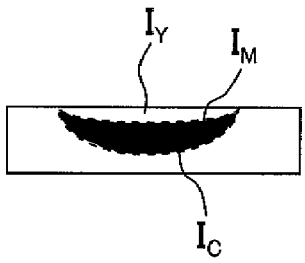
FIG. 19B is a partial sectional view of the recording paper showing the order in which the color inks land during the leftward movement of the conventional ink-jet head.

In a case that the four color inks are jetted onto the recording paper 7 both during the movement of the ink-jet head in the first moving direction (outgoing movement; first movement) and during the movement of the ink-jet head in the second moving direction (returning movement; second movement), the order in which the color inks land differs during the first movement and during the second movement as shown in FIGS. 18 and 19 described above. Therefore, a difference in color tint occurs between an area onto which the inks landed during the first movement and an another area onto which the inks landed during the second movement, and thus color banding clearly appears and the printing quality degrades.

As shown in FIG. 4, however, in the ink-jet head 1 of the present embodiment, the nozzle group 21 of each jetting unit 8 has a high density portion 22, positioned at the central portion in the paper feeding direction, and two low density portions 23 and 24 which are positioned at both sides, respectively, in the paper feeding direction of the high density portion 22 and in which the nozzles are arranged at a spacing distance greater than that in the high density portion 22, thereby making it possible to suppress the above-described color banding. The operation of the nozzle groups 21 will be explained in detail with reference to FIGS. 9A, 9B and 10A, 10B.

Figure 9A:
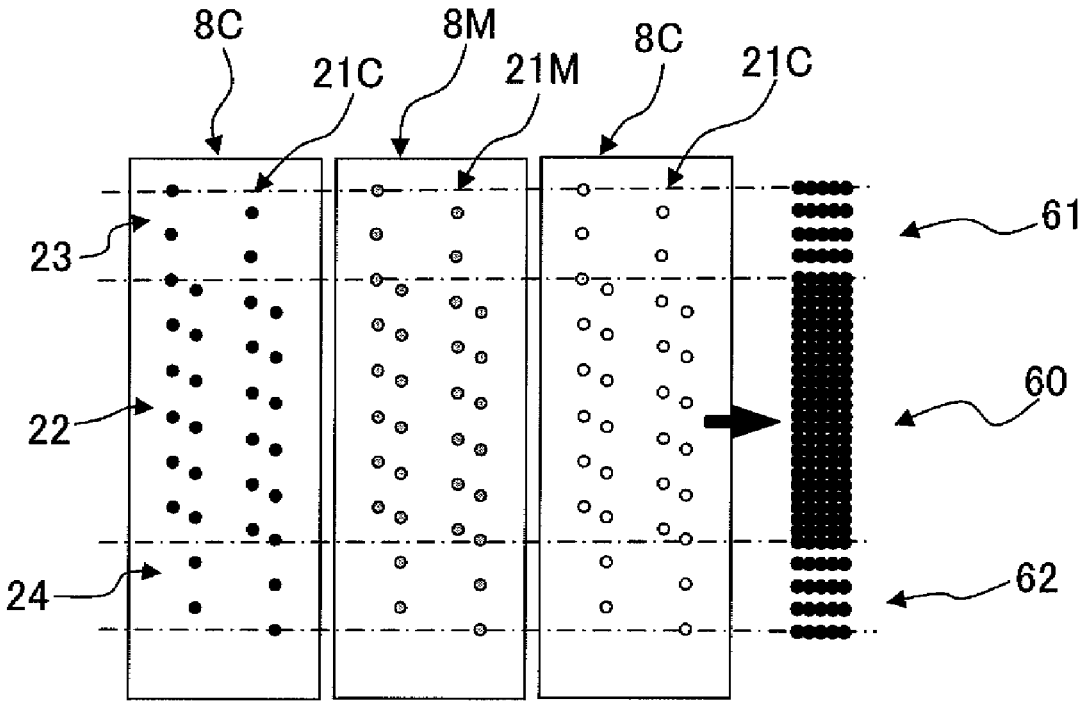
FIG. 9A is a diagram showing a state in which color inks land during a first movement of the ink-jet head.
Figure 9B:
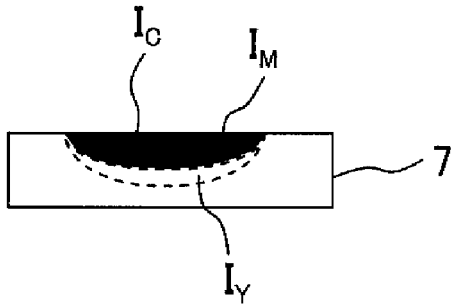
FIG. 9B is a partial sectional view of a recording paper showing the order in which the color inks land during a second movement.

First, as shown in FIG. 9A, when the inks are jetted while the ink-jet head 1 is moved toward the right (in the first moving direction), then, as shown in FIG. 9B, the three color inks ($I_C$, $I_M$, and $I_Y$) land on the recording paper 7 in the order that the three kinds of nozzle groups 21C, 21M, and 21Y are positioned from the right side, which is the downstream side of the movement direction of the ink-jet head 1, namely in the order of Y (yellow) to M (magenta), then to C (cyan) (Y-M-C order), during the first movement. Therefore, the color tint of the color image recorded during the first movement tends to be a color tint which is biased toward cyan which is the ink landed last (more bluish tint). In this process, in an area 60 of the recording paper 7, onto which the inks jetted from the high density portions 22 land, dots are formed at spacing distance of 0.25 P in the paper feeding direction (up and down direction of FIG. 9A). On the other hand, in areas 61 and 62 of the recording paper 7, onto which the inks from the two low density portions 23 and 24 land, respectively, dots are formed at spacing distance of 0.5 P in the paper feeding direction.

Figure 10A:
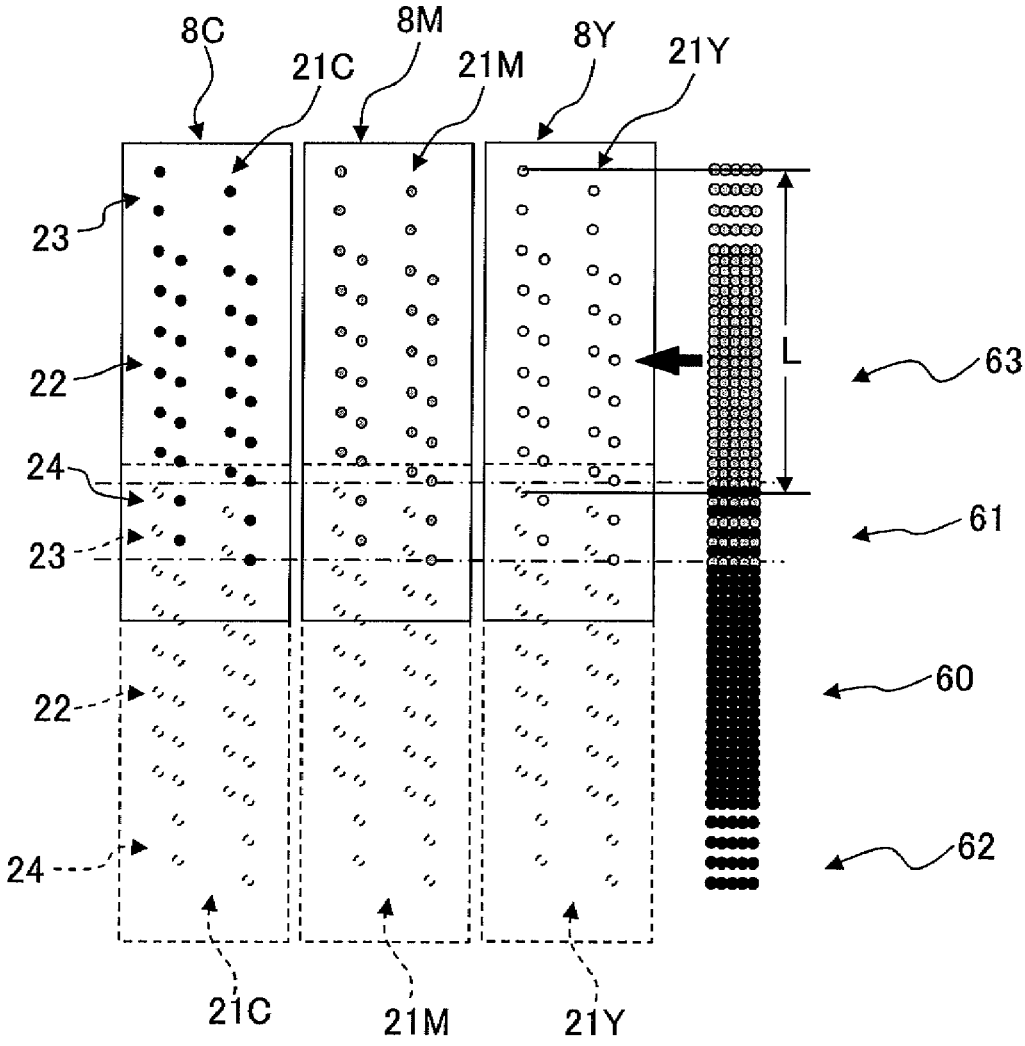
FIG. 10A is a diagram of a state in which the color inks land during the first movement of the ink-jet head.
Figure 10B:
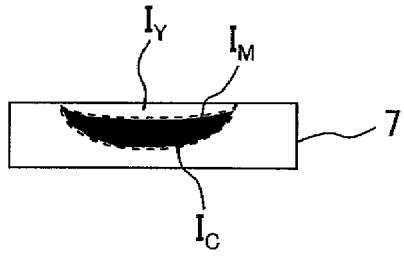
FIG. 10 is a partial sectional view of the recording paper showing the order in which the color inks land during the second movement.

Next, as shown in FIGS. 10A and 10B, the recording paper 7 is then fed in the paper feeding direction (downward in FIG. 10A) by the feed roller 5 (see FIG. 1) as shown in FIG. 10A. In FIG. 10A, a relative position of the ink-jet head 1 with respect to the recording paper 7 prior to the feeding is indicated by broken lines, and a relative position of the ink-jet head 1 with respect to the recording paper 7 after the feeding is indicated by solid lines. At this time, the recording paper 7 is fed just by a predetermined distance L so that the area 61, onto which the inks from the low density portion 23 at the upstream in the paper feeding direction (upper side in FIG. 10A) landed during the first movement, comes to a position directly below the low density portion 24 at the downstream in the paper feeding direction (lower side in FIG. 10B).

Then, as shown in FIG. 10A, when the inks are jetted while the ink-jet head 1 is moved to the left (in the second moving direction), the three color inks ($I_C$, $I_M$, and $I_Y$) land on the recording paper 7 in the order in which the three kinds of nozzle groups 21C, 21M, and 21Y are positioned from the left side, which is the downstream in the movement direction (outgoing movement) of the ink-jet head 1, namely in the order of C (cyan) to M (magenta), then to Y (yellow) (C-M-Y order) during the second movement as shown in FIG. 10B. Therefore, the color tint of the color image which is recorded during the second movement tends to have a color tint which is biased toward yellow which is the ink landed last (yellowish tint). At this time, in an area 63 of the recording paper 7 which is adjacent to the area 61 at the upstream in the paper feeding direction, the inks jetted from the high density portions 22 land so as to form dots at spacing distance of 0.25 P in the paper feeding direction (up and down direction in FIG. 9A).

On the other hand, the inks, jetted from the low density portion 24 at the downstream in the paper feeding direction, land on portions between the dots formed in the area 61 by the inks jetted from the low density portion 23 at the upstream in the paper feeding direction during the first movement. That is, in the area 61, the dots formed by the inks jetted in the order of Y to M then to C (Y-M-C order) from the low density portion 23 for each of the three colors during the first movement, and the dots formed by the inks jetted in the order of C to M then to Y (C-M-Y order) from the low density portion 24 for each of the three colors during the second movement, are mixed. These two kinds of dots are of the same dot spacing distance (resolution) as those in the areas 60 and 63, and are aligned in the paper feeding direction at an spacing distance of 0.25 P. Namely, an intermediate area 61 is thus located (formed) between the area 60 onto which the inks jetted from the high density portions 22 for each of the three colors landed in the Y-M-C order during the first movement, and the area 63 onto which the inks jetted from the high density portions 22 for each of the three colors landed in the C-M-Y order during the second movement. The dot spacing distance in the intermediate area 61 is equal to those in the two areas 60 and 63, and the color tint of the dots in the intermediate area 61 is a color tint which is intermediate between the color tints of the dots in the areas 60 and 63. Accordingly, the color tint between the two areas 60 and 63 which differ in the order of landing of the color inks gradually changes because the intermediate area 61 is interposed therebetween, thereby making the color banding to be inconspicuous and thus improving the printing quality.

As shown in FIGS. 3 and 4, each of the nozzle groups 21 includes four nozzle rows 20*a* to 20*d* of equal length (number of nozzles 20) and equal spacing distance between the nozzles 20. Among the nozzle rows, two adjacent nozzle rows (nozzle rows 20*a* and 20*b*, and nozzle rows 20*c* and 20*d*) are arranged at positions shifted from each other in the paper feeding direction, thereby forming the high density portion 22 and the two low density portions 23 and 24. Thus, although each of the nozzle groups 21 has the high density portion 22 and the low density potions 23 and 24, the high density portion 22 and the low density potions 23 and 24 are considerably simple in construction and are easily formed.

Next, an explanation will be given about modifications in each of which various changes are made to the embodiment. Parts or components of the modification, which are same in construction as those in the embodiment, will be assigned with same reference numerals and any explanation therefor will be omitted as appropriate.

First Modification

Figure 11:
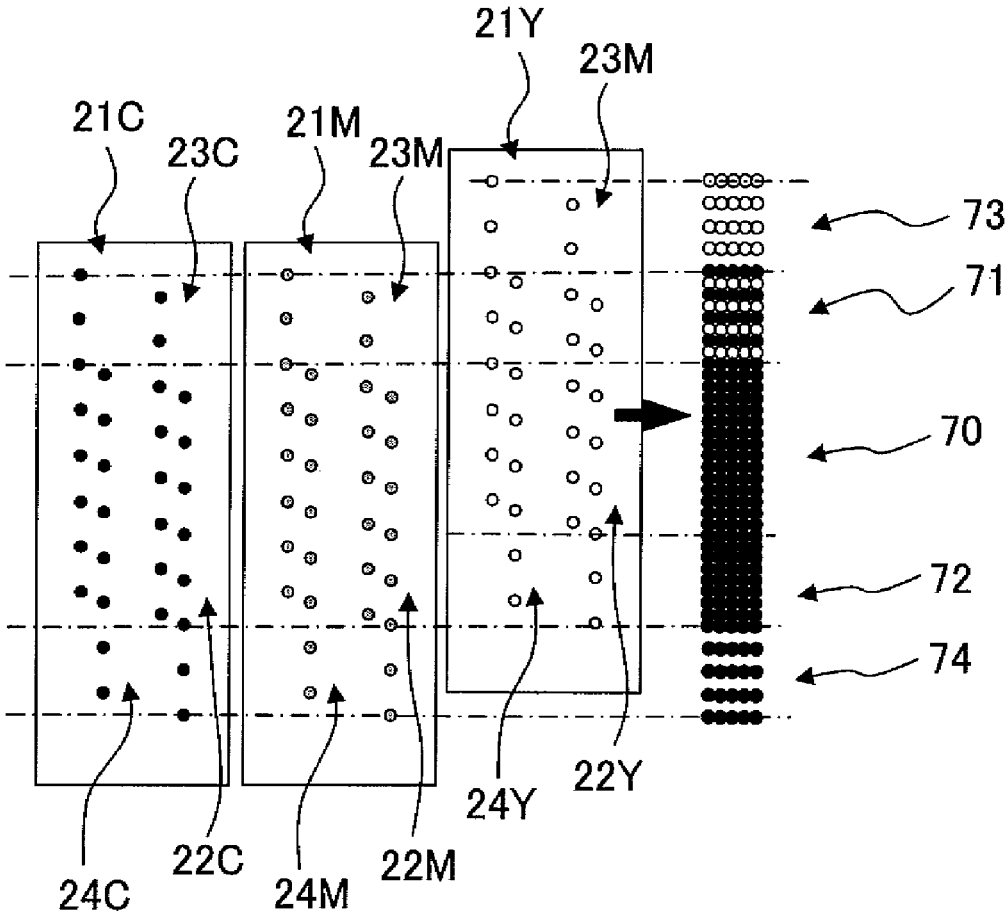
FIG. 11 is a diagram showing a state in which the color inks land during the first movement of an ink-jet head according to a first modification.

Among the three nozzle groups 21 (21C, 21M, and 21Y) which jet three color inks respectively, at least one nozzle group 21 may be arranged at a position shifted in the paper feeding direction with respect to the other nozzle groups 21. As shown in FIG. 11, for example, a nozzle group 21Y, which is positioned at the right end and jets an yellow ink, is arranged at a position shifted toward the upstream in the paper feeding direction (upper side in FIG. 11) with respect to a cyan nozzle group 21C and a magenta nozzle group 21M arranged to the left of the nozzle group 21Y. Low density portions 23Y and 24Y of the yellow nozzle group 21Y are disposed at positions which are adjacent, in the paper feeding direction (up and down direction in FIG. 11), with respect to low density portions 23C and 24C of the cyan nozzle group 21C and with respect to low density portions 23M and 24M of the magenta nozzle group 21M.

As shown in FIG. 11, by the jetting of the inks during the rightward movement (first moving direction), five areas 70 to 74 which differ in color tint are formed on the recording paper 7. Namely, at a central portion in the paper feeding direction, an area 70 of a color tint which is biased toward cyan (bluish tint) is formed by the inks landed from the high density portions 22 (22C, 22M, and 22Y) of the three colors in the Y-M-C order. Also, at an upstream in the paper feeding direction of the area 70, an area 71 is formed, in which dots formed by the inks landed from the cyan and magenta low density portions 23C and 23M, and from the yellow high density portion 22Y in the Y-M-C order, and dots of the yellow ink jetted from the yellow high density portion 22Y are mixed. At a downstream in the paper feeding direction of the area 70, an area 72 is formed in which dots formed by the inks landed from the cyan and magenta high density portions 22C and 22M and from the yellow low density portion 24Y in the Y-M-C order, and dots formed by the inks landed from the cyan and magenta high density portions 22C and 22M in an order of M to C (M-C order) are mixed. Furthermore, at an upstream end in the paper feeding direction, an area 73 is formed of dots of the yellow ink-jetted from the yellow low density portion 23Y; and at a downstream end in the paper feeding direction, an area 74 is formed from dots formed of the inks landed from the cyan and magenta low density portions 24C and 24M in the M-C order.

Figure 12:
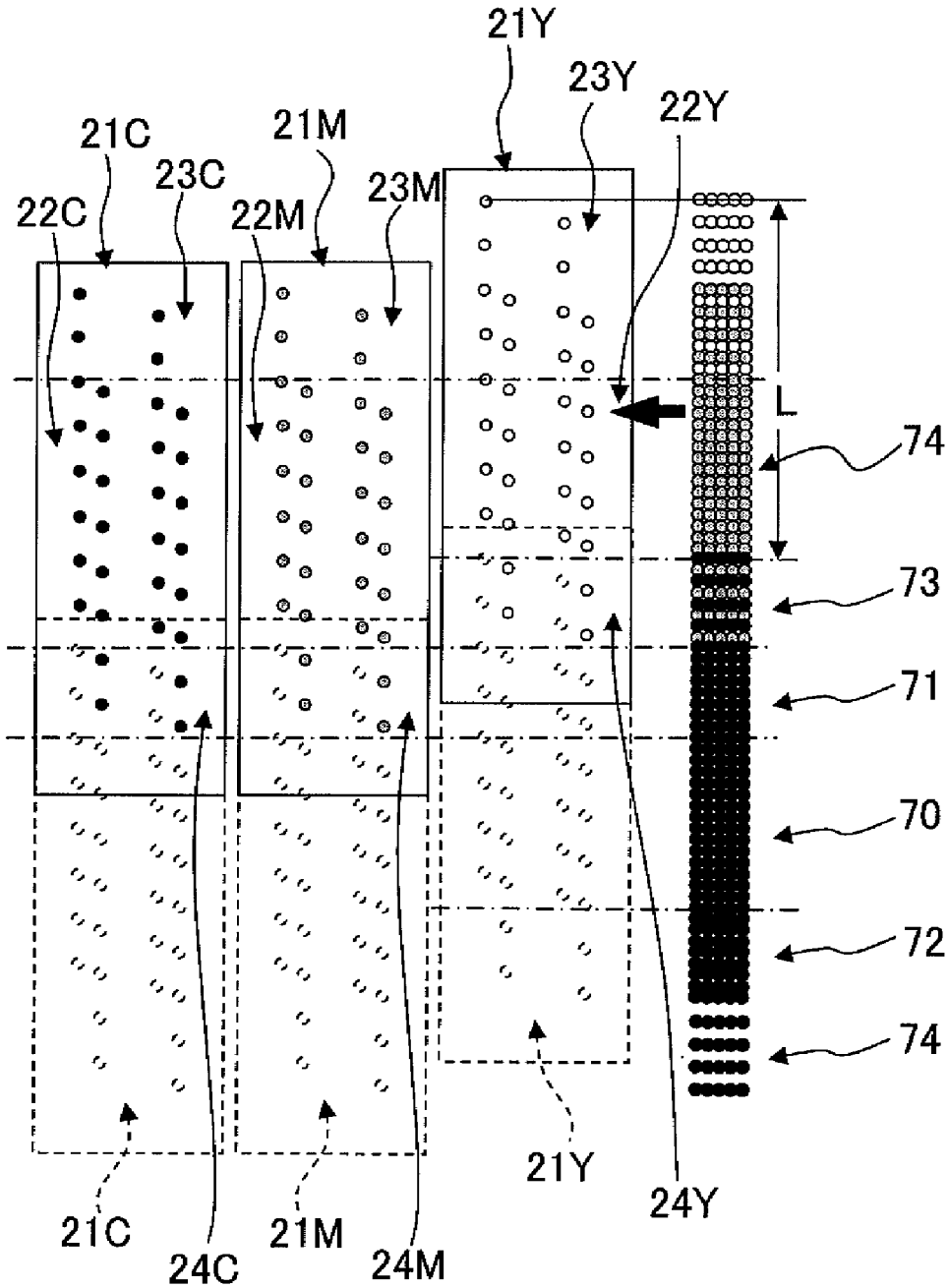
FIG. 12 is a diagram showing a state in which the color inks land during the second movement of the ink-jet head according to the first modification.

As shown in FIG. 12, after the recording paper has been fed in the paper feeding direction just by the predetermined distance L so that the areas 71 and 73, onto which the inks from the low density portions 23 at the upstream in the paper feeding direction of the nozzle groups 21 landed, are positioned directly below the low density portions 24 at the downstream in the paper feeding direction, the ink-jet head 1 jets ink again while moving to the left (in the second moving direction). In this process, an area 75, the color tint of which is biased toward yellow (yellowish tint), is formed by the inks landing from the high density portions 22C, 22M, and 22Y of the three colors in the C-M-Y order. The area 75 is formed adjacent to the area 73 which has been formed at the downstream end in the paper feeding direction during the first movement. Namely, two intermediate areas 71 and 73 are thus positioned between the two areas 70 and 75 onto which the inks from the high density portions 22C, 22M, and 22Y landed during the first movement and the second movement.

The intermediate area 71 is positioned at the downstream of the intermediate area 73 in the paper feeding direction. During the second movement, the inks from the two low density portions 24C and 24M for cyan and magenta land in the C-M order onto the dots, among the dots formed during the first movement (see FIG. 11), formed only from the yellow ink. Namely, in this area, the dots formed by the inks landed in the Y-M-C order during the first movement, and the dots formed by the inks landed in the Y-C-M order in which the yellow ink landed during the first movement and the cyan and magenta inks landed during the second movement, are mixed. In the intermediate area 73 positioned at the upstream of the intermediate area 71 in the paper feeding direction, the inks from the two high density portions 22C and 22M for cyan and magenta land in the C-M order during the second movement onto the dots formed from just the yellow ink during the first movement. Further, during the second movement, the inks land from the two high density portions 22C and 22M for cyan and magenta and the yellow low density portion 24Y in the C-M-Y order. Accordingly, in this area, the dots landed in the Y-C-M order and the dots landed in the C-M-Y order are mixed.

Thus, the area 70 in which dots of cyan-biased color tint formed by the inks landing in the Y-M-C order during the first movement; the area 74 in which dots of yellow-biased color tint are formed by the inks landing in the C-M-Y order during the second movement; the intermediate area 71 in which the dots landed in Y-M-C order and having cyan-biased color tint and the dots landed in the Y-C-M order and having magenta-biased color tint are mixed; and the intermediate area 73 in which the dots landed in the Y-C-M order and having magenta-biased color tint and the dots landed in the C-M-Y order and having a yellow-biased color tint are mixed, are formed on the recording paper 7. Because the two kinds of intermediate areas 71 and 73 are present between the area 70 and the area 75, the change of color between the area 70 and the area 75 is made gradual, the color banding is thus made inconspicuous, and the printing quality is improved.

Second Modification

Figure 13:
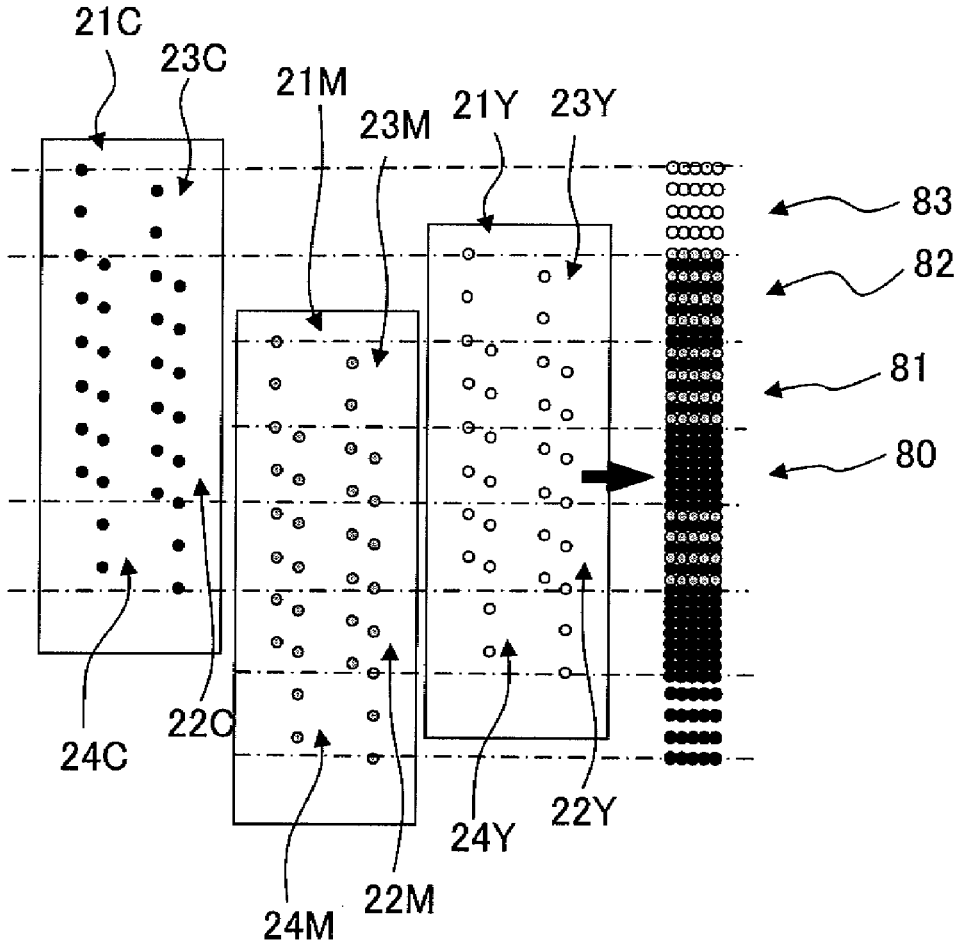
FIG. 13 is a diagram showing a state in which the color inks land during the first movement of an ink-jet head according to a second modification.

The nozzle groups 21C, 21M, and the 21Y of the three colors which respectively jet the three color inks may be arranged at positions shifted from one another in the paper feeding direction. For example, as shown in FIG. 13, an yellow nozzle group 21Y at the right end is shifted toward the upstream in the paper feeding direction (upper side in FIG. 13) with respect to a magenta nozzle group 21M at the center, and further a cyan nozzle group 21C at the left end is shifted toward the upstream in the paper feeding direction with respect to the yellow nozzle group 21Y. In the paper feeding direction, the low density portions 23 of the nozzle groups 21 of the three colors are positioned adjacent each other in the order of cyan (23C, 24C), yellow (23Y, 24Y), and magenta (23M, 24M) from the upstream side.

Figure 14:
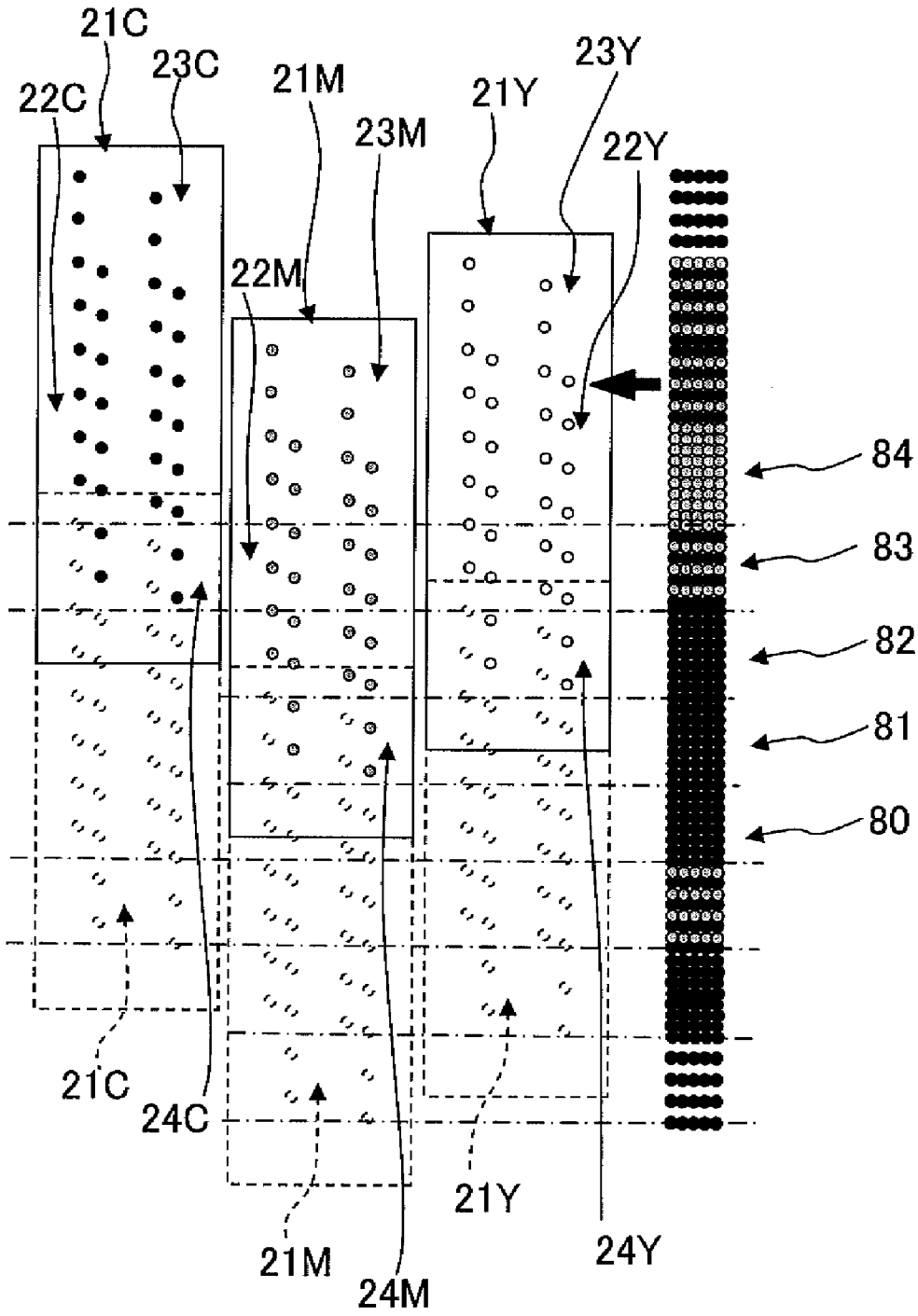
FIG. 14 is a diagram showing a state in which the color inks land during the second movement of the ink-jet head according to the second modification.

In this case, as shown in FIGS. 13 and 14, during the first movement of the ink-jet head 1, the inks from the three high density portions 22C, 22M, and 22Y land in the order of Y to M then to C (Y-M-C order) to form an area 80 of a cyan-biased color tint; and during the second movement of the ink-jet head 1, the inks from the three high density portions 22C, 22M, and 22Y land in the order of C to M then to Y (C-M-Y order) to form an area 84 of a yellow-biased color tint. Further, three areas 81, 82, and 83 are formed between the areas 80 and 84. Among the three areas 81, 82, and 83, the area 81 positioned at the most downstream side has dots landed in the Y-M-C order and having a cyan-biased color tint and dots landed in the Y-C-M order and having a magenta-biased color tint mixed therein. The central area 82 has dots landing in Y-C-M order and having a magenta-biased color tint and dots landing in C-M-Y order and having yellow-biased color tint mixed therein. The area 83 at the most upstream side is formed of dots landed in the C-M-Y order and has of the same color tint as that of the area 84. In this modification also, the two kinds of intermediate areas 81 and 82 are present between the area 80 of cyan-biased color tint in which the inks landed in the Y-M-C order and the areas 83 and 84 of yellow-biased color tint in which the inks landed in the C-M-Y order, thereby making any color banding to be inconspicuous and thus improving the printing quality.

Third Modification

Among two nozzle groups 21 arranged at position which are mutually shifted, low density portions 23 and 24 of one of the two nozzle groups 21 and low density portions 23 and 24 of the other of the two nozzle groups 21 may be positioned so as to be partially overlapped as viewed from the scanning direction. For example, in FIG. 15, an yellow nozzle group 21Y positioned at the right end is shifted toward the upstream in the paper feeding direction with respect to a cyan nozzle group 21C and a magenta nozzle group 21M which are positioned to the left of the yellow nozzle group 21Y; and yellow low density portions 23Y and 24Y partially overlap with cyan low density portions 23C and 24C and magenta low density portions 23M and 24M just by a pitch P as viewed in the scanning direction (left and right direction). In other words, the shift amount of the yellow nozzle group 21Y in the paper feeding direction is the pitch P.

Figure 15:
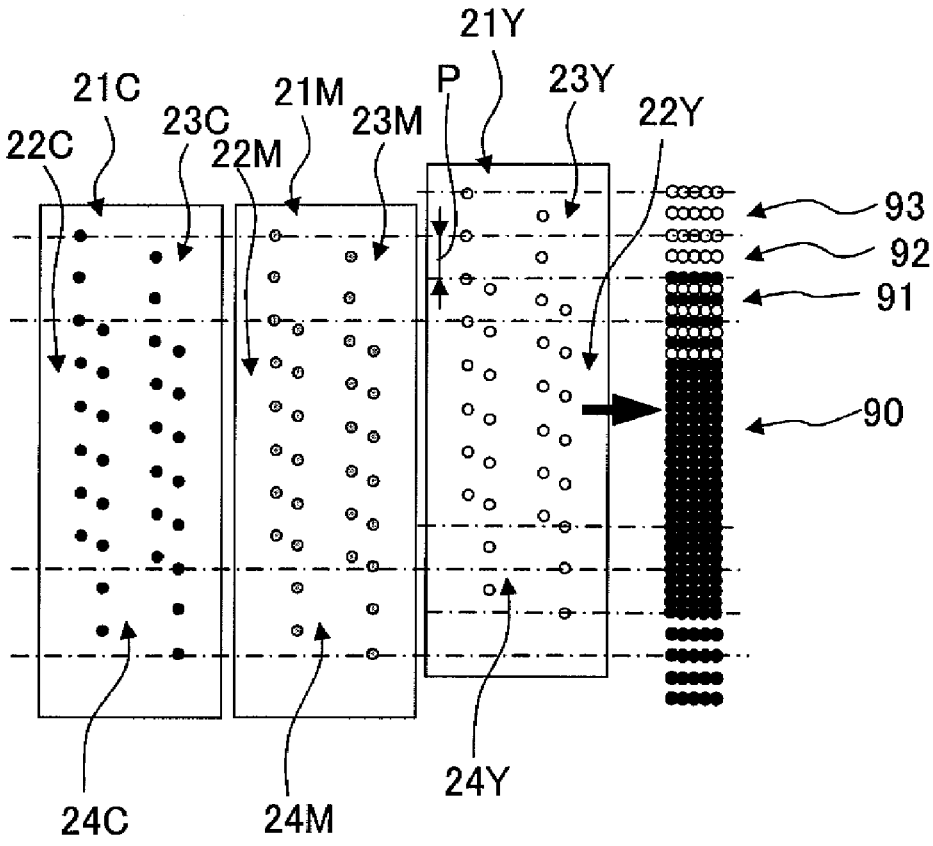
FIG. 15 is a diagram showing a state in which the color inks land during the first movement of an ink-jet head according to a third modification.
Figure 16:
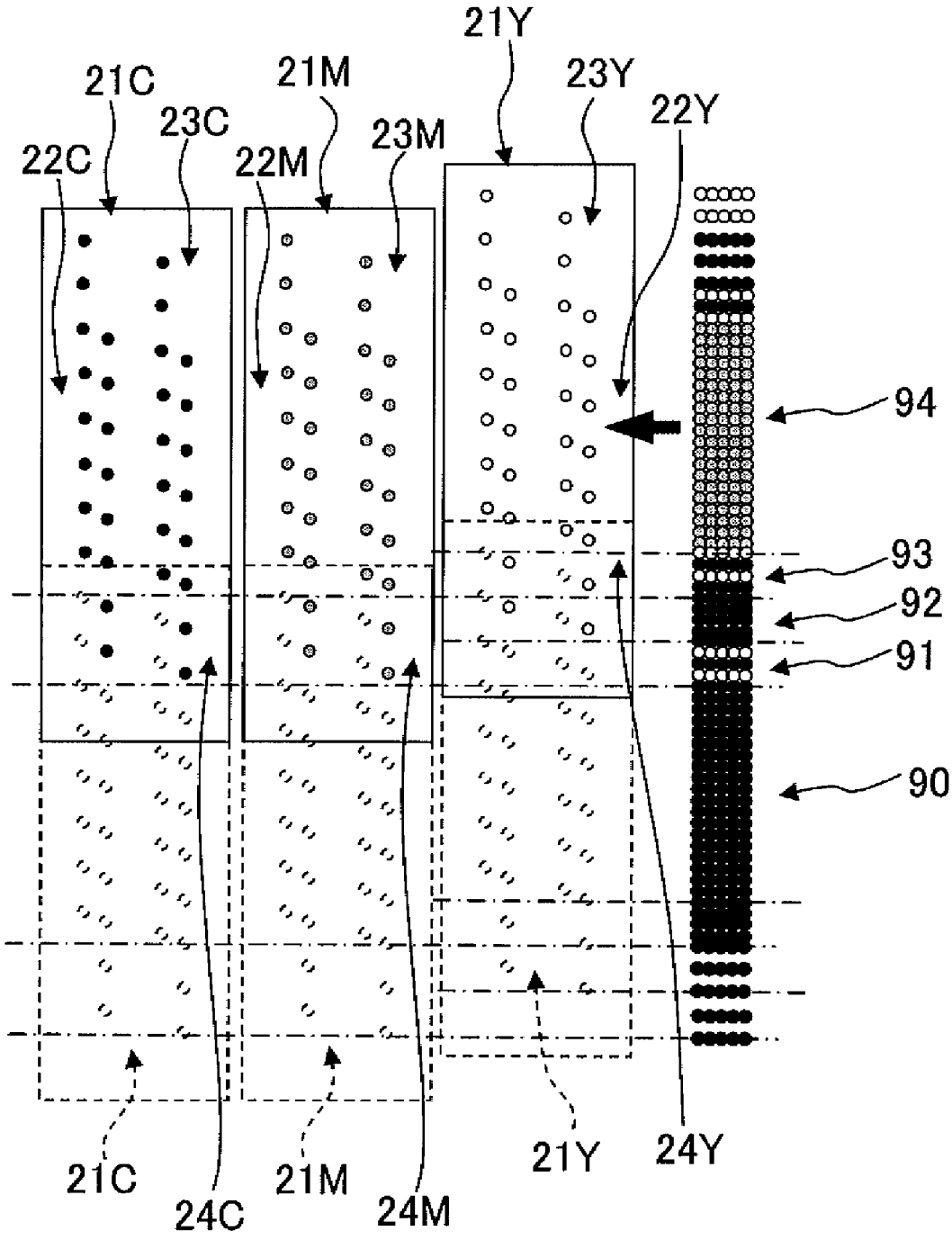
FIG. 16 is a diagram showing a state in which the color inks land during the second movement of the ink-jet head according to the third modification.

As shown in FIGS. 15 and 16, during the first movement of the ink-jet head 1, the inks from the three high density portions 22C, 22M, and 22Y land in an order of Y to M then to C (Y-M-C order) to form an area 90 of a cyan-biased color tint; and during the second movement of the ink-jet head 1, the inks from the three high density portions 22C, 22M, and 22Y land in an order of C to M then to Y (C-M-Y order) to form an area 94 of a yellow-biased color tint. Further, three intermediate areas 91, 92, and 93 are formed between the areas 90 and 94. Among the three areas 91, 92, and 93, the area 91 at the most downstream side has dots landed in the Y-M-C order and having a cyan-biased color tint and dots landed in an order of Y to C then to M (Y-C-M order) and having a magenta-biased color tint mixed therein. The central area 92 at the center has dots landed in the Y-M-C order and having a cyan-biased color tint and dots formed in an order of C to M then to Y (C-M-Y order) and having a yellow-biased color tint mixed therein. Furthermore, the area 93 at the most upstream side has dots landed in the Y-C-M order and having a magenta-biased color tint and dots landed in C-M-Y order and having a yellow-biased color tin mixed therein. In this modification, since the three intermediate areas 91 to 93 are present between the area 90 of cyan-biased color tint in which the inks landed in the Y-M-C order, and the area 94 of yellow-biased color tint in which the inks landed in the C-M-Y order, color banding is made inconspicuous and the printing quality is thus improved.

Fourth Embodiment

Figure 17:
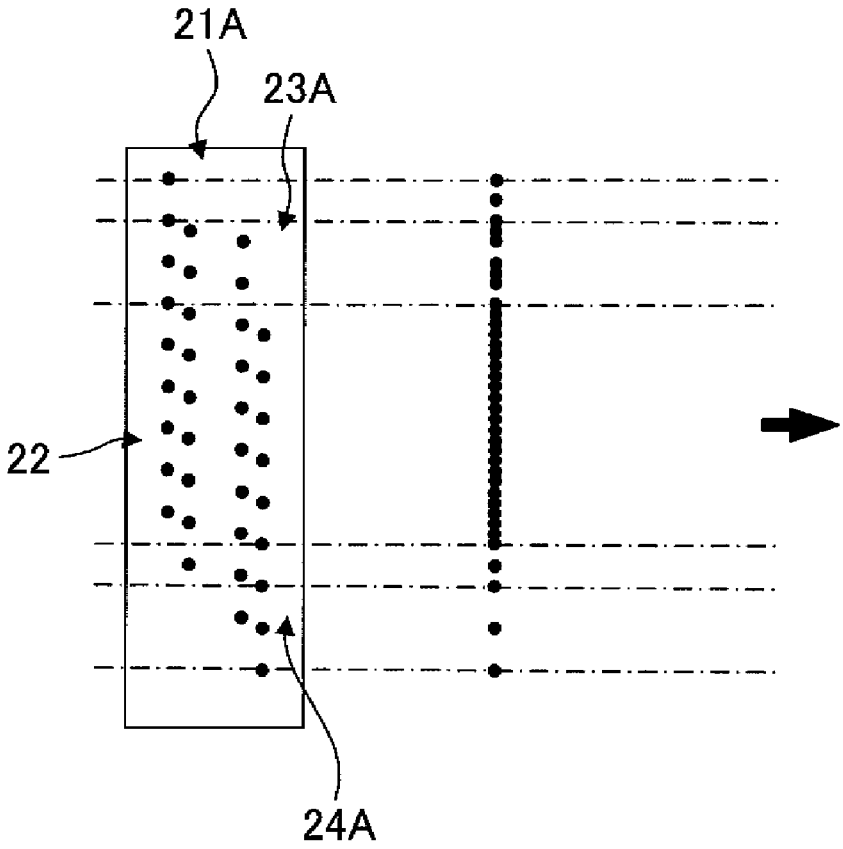
FIG. 17 is a diagram showing a nozzle group according to a fourth modification.

It is not necessarily indispensable that the nozzle spacing distance in the low density portions are fixed or constant. Alternatively, as shown in FIG. 17, the nozzle spacing distance in two low density portions 23A and 24A of a nozzle group 21A may be increased or widened toward both ends in the paper feeding direction, respectively. In this case, since the nozzle spacing distance in each of the low density portions 23A and 24A are changed in a stepwise manner, not less than two kinds of intermediate areas can be formed, by the two low density portions 23A and 24A, between an area in which dots are formed by the high density portion 22 during the first movement and an area in which dots are formed by the high density portion during the second movement, without arranging the nozzle groups 21C, 21M, and 21Y of the three colors at positions shifted from one another in the paper feeding direction. The difference in color tint between the areas formed by the high density portions 22 can thus be made inconspicuous. It should be noted that the nozzle spacing distance in each of the two low density portions 23A and 24A is appropriately set so that the spacing distance between dots formed by the jetting of ink once at a time onto the same area from the two low density portions 23A and 24A is same as the spacing distance between dots formed by one time of jetting from the high density portion 22. Further, with respect to a plurality of nozzle rows forming each of the nozzle groups, it is possible to vary or change the nozzle spacing distance in the paper feeding direction for low density portions for each of the nozzle groups by differing the number of nozzles 20 for each of the nozzle rows forming one of the nozzle groups.

In the above-described embodiment and modifications thereof, it is not necessarily indispensable that a nozzle group is formed of four nozzle rows. Alternatively, the nozzle groups may be formed, for example, of one nozzle row or any arbitrary number of nozzle rows. Alternatively, the number of nozzle groups which jet inks of different colors is not limited to four and may be changed as appropriate according to the number of inks used. Still alternatively, when the inks are to be discharged only when the ink-jet head moves toward one side of the scanning direction, for example, the inks may be jetted only from the high density portions of the nozzle groups without jetting the inks from the low density portions of the nozzle groups.

What is claimed is:

1. An ink-jet head which discharges a plurality of different color inks onto a recording medium, comprising a plurality of nozzle groups which jet the inks onto the recording medium respectively, and each of which is formed by a nozzle row formed by a plurality of nozzles arranged in a predetermined direction that is parallel to a paper feed direction;

wherein each of the nozzle groups has a high density portion formed therein and positioned at a central portion thereof in the predetermined direction;

two low density portions which are positioned at both sides in the predetermined direction, respectively, of the high density portion and in which the nozzles are arranged in the predetermined direction at a spacing distance greater than a spacing distance at which the nozzles are arranged in the high density portion; and two nozzle groups, among the plurality of nozzle groups, are arranged at positions shifted from each other in the predetermined direction such that at least a part of the high density portion of one of the two nozzle groups overlaps with a part of the low density portions of the other of the two nozzle groups.

2. The ink-jet head according to claim 1, wherein low density portions of one of the two nozzle groups and low density portions of the other of the two nozzle groups are arranged adjacently in the predetermined direction.

3. The ink-jet head according to claim 1, wherein low density portions of one of the two nozzle groups and low density portions of the other of the two nozzle groups partially overlap with each other as viewed in a direction orthogonal to the predetermined direction.

4. The ink-jet head according to claim 1, wherein the spacing distance at which the nozzles are arranged in the low density portions of each of the nozzle groups is two times the spacing distance at which the nozzles are arranged in the high density portion.

5. The ink-jet head according to claim 1, wherein the spacing distance at which the nozzles are arranged in the low density portions of each of the nozzle groups is increased toward both ends, in the predetermined direction, of each of the nozzle groups.

6. The ink-jet head according to claim 1, wherein:

each of the nozzle groups has two nozzle rows in which the nozzles are arranged at the predetermined spacing distance in the predetermined direction;

the two nozzle rows are equal in a length in the predetermined direction; and the two nozzle rows are arranged at positions shifted from each other in the predetermined direction.

7. An ink-jet printer which discharges a plurality of different color inks onto a recording medium to perform printing on the recording medium, comprising:

the ink-jet head as defined in claim 1; and a feeding mechanism which feeds the recording medium in an orthogonal direction orthogonal to the predetermined direction.

8. The ink-jet printer according to claim 7, wherein:

the ink-jet head is reciprocapable in the orthogonal direction; and the ink-jet head jets the inks from the plurality of nozzle groups, respectively, both during movement of the ink-jet head toward one side of the orthogonal direction and during movement of the ink-jet head toward the other side of the orthogonal direction.

9. The ink-jet printer according to claim 8, wherein low density portions of one of the two nozzle groups and low density portions of the other of the two nozzle groups are arranged adjacently in the predetermined direction.

10. The ink-jet printer according to claim 8, wherein low density portions of one of the two nozzle groups and low density portions of the other of the two nozzle groups partially overlap as viewed in the orthogonal direction.

11. The ink-jet printer according to claim 8, wherein the spacing distance at which the nozzles are arranged in the low density portions of each of the nozzle groups is two times the spacing distance at which the nozzles are arranged in the high density portion.

12. The ink-jet printer according to claim 8, wherein the spacing distance at which the nozzles are arranged in the low density portions of each of the nozzle groups is increased toward both ends, in the predetermined direction, of each of the nozzle groups.

13. The ink-jet printer according to claim 8, wherein:

each of the nozzle groups has two nozzle rows in which the nozzles are arranged at the predetermined spacing distance in the predetermined direction;

the two nozzle rows are equal in a length in the predetermined direction; and the two nozzle rows are arranged at positions shifted from each other in the predetermined direction.

14. An ink-jet head which discharges a plurality of different color inks onto a recording medium, comprising a plurality of nozzle groups which jet the inks onto the recording medium respectively, and each of which is formed by a nozzle row formed by a plurality of nozzles arranged in a predetermined direction that is parallel to a paper feed direction;

wherein each of the nozzle groups has a high density portion formed therein and positioned at a central portion thereof in the predetermined direction;

two low density portions which are positioned at both sides in the predetermined direction, respectively, of the high density portion and in which the nozzles are arranged in the predetermined direction at a spacing distance greater than a spacing distance at which the nozzles are arranged in the high density portion; and in the low density portions, the nozzles are arranged such that the spacing distance is increased in a stepwise manner toward both ends, in the predetermined direction.

* * * * *